US010532910B2

(12) United States Patent
Qiu et al.

(10) Patent No.: US 10,532,910 B2
(45) Date of Patent: Jan. 14, 2020

(54) UNDERSLUNG ELEVATOR CAR CONFIGURATION

(71) Applicant: OTIS ELEVATOR COMPANY, Farmington, CT (US)

(72) Inventors: Minglun Qiu, Bloomfield, CT (US); Anying Shen, Avon, CT (US); Richard S. Blakelock, Florence, SC (US); Jay S. Lengacher, Washington, IN (US); Brian K. Meek, Bloomington, IN (US); Scott E. McCullough, Springville, IN (US); Charles S. Darling, Kensington, CT (US); Patricia Derwinski, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 243 days.

(21) Appl. No.: 15/636,914

(22) Filed: Jun. 29, 2017

(65) Prior Publication Data

US 2017/0297869 A1 Oct. 19, 2017

Related U.S. Application Data

(62) Division of application No. 12/990,876, filed as application No. PCT/US2008/067195 on Jun. 17, 2008, now Pat. No. 9,701,515.

(51) Int. Cl.
*B66B 11/02* (2006.01)
*B66B 19/00* (2006.01)

(52) U.S. Cl.
CPC ..... *B66B 11/0206* (2013.01); *B66B 11/02* (2013.01); *B66B 11/0273* (2013.01); *B66B 19/007* (2013.01)

(58) Field of Classification Search
CPC .... B66F 9/127; B66F 9/12; B66F 7/26; B66F 7/28; B66F 9/02; B66F 9/07563
See application file for complete search history.

(56) References Cited

U.S. PATENT DOCUMENTS 3,101,130 A 8/1963 Bianca
5,199,529 A 4/1993 Salmon
(Continued)

FOREIGN PATENT DOCUMENTS

CN 101074079 A 11/2007
JP 60244787 12/1985
(Continued)

OTHER PUBLICATIONS

International Preliminary Report on Patentability for International application No. PCT/US2008/067195 dated Dec. 29, 2010.
(Continued)

*Primary Examiner* — Diem M Tran
(74) *Attorney, Agent, or Firm* — Carlson, Gaskey & Olds

(57) ABSTRACT

An exemplary elevator system includes an elevator car having an integrated cabin and car frame structure including a platform thickness between a floor surface in the cabin and a lowermost surface on a support beam used for supporting the car beneath the floor surface. A sheave assembly is supported beneath the floor surface. The sheave assembly includes a plurality of sheaves and a plurality of subframe beams. The sheaves and subframe beams fit within the platform thickness such that the subframe beams and the sheaves are no lower than the lowermost surface on the support beam. A plurality of isolation members are between the sheave assembly and the elevator car for isolating an interior of the cabin from vibrations associated with movement of the sheaves.

8 Claims, 4 Drawing Sheets

(56) References Cited

U.S. PATENT DOCUMENTS

| | | | | |
|---|---|---|---|---|
| 5,613,667 | A | 3/1997 | Ho | |
| 6,305,502 | B1 | 10/2001 | He et al. | |
| 6,640,935 | B1 | 11/2003 | Murakami et al. | |
| 7,543,685 | B2 | 6/2009 | Ach et al. | |
| 9,718,644 | B2 * | 8/2017 | Kyue | B66B 11/0226 |
| 2003/0102613 | A1 | 6/2003 | Alves | |
| 2004/0173411 | A1 | 9/2004 | Silberhorn et al. | |
| 2005/0006180 | A1 | 1/2005 | Mustalahti et al. | |
| 2006/0070819 | A1 | 4/2006 | Schaffhauser et al. | |
| 2006/0175140 | A1 | 8/2006 | Kolb et al. | |
| 2008/0099285 | A1 | 5/2008 | Det et al. | |
| 2009/0057070 | A1 | 3/2009 | Maury | |
| 2010/0126808 | A1 | 5/2010 | Hashiguchi | |
| 2017/0158466 | A1 * | 6/2017 | De Jong | B66B 11/0273 |

FOREIGN PATENT DOCUMENTS

| | | | | |
|---|---|---|---|---|
| JP | 2001122564 | | 5/2001 | |
| JP | 2001247278 | A | 9/2001 | |
| JP | 2002128428 | A | 5/2002 | |
| JP | 2003227545 | A | 8/2003 | |
| JP | 2005001773 | A | 1/2005 | |
| JP | 2006151634 | A | 6/2006 | |
| WO | WO-2007094367 | A1 * | 8/2007 | B66B 11/02 |

OTHER PUBLICATIONS

International Search Report and Written Opinion of the International Searching Authority for International application No. PCT/US2008/067195 dated Mar. 12, 2009.

Supplementary Search—State Intellectual Property Office of People's Republic China—Application No. CN200880129947.5 dated May 3, 2013.

* cited by examiner

UNDERSLUNG ELEVATOR CAR CONFIGURATION

CROSS REFERENCE TO RELATED DOCUMENTS

This application is a divisional of U.S. patent application Ser. No. 12/990,876 filed Nov. 3, 2010, which is the national stage application of PCT/US2008/067195, filed Jun. 17, 2008.

BACKGROUND

Elevator systems include various types of drives for moving an elevator car among various landings. Traction drive systems utilize a roping arrangement for supporting the weight of the elevator car and a counterweight. A traction sheave is associated with a motor for moving the roping arrangement to cause desired movement of the elevator car. There are a variety of such configurations known in the art.

One approach includes having deflector sheaves supported on the elevator car such that the roping passes beneath the elevator car as it bends around those sheaves. Such an arrangement is typically called underslung because the sheaves and roping are beneath the floor of the elevator car. Examples of underslung elevator car arrangements are shown, for example, in U.S. Pat. Nos. 5,931,265; 6,397,974; 6,443,266; 6,715,587 and 6,860,367. Another underslung arrangement is shown in the United States Patent Application Publication No. US 2006/0175140.

One challenge associated with utilizing an underslung arrangement is keeping the overall elevator car design compact to achieve space savings. For example, pit depth requirements are based, at least in part, on the configuration of the elevator car. It would be desirable to be able to achieve the benefits of more modern elevator car configurations while using an underslung arrangement without sacrificing the size benefits afforded by a more modern elevator car design.

With conventional arrangements, typical elevator cars include a frame structure and a separate cabin. Vibration isolating elements typically have been provided for mounting the cabin to the frame to achieve a desired ride quality. If an elevator system were to include a different elevator car design, the typical approach would no longer be available for achieving a desired level of vibration isolation. For example, if one were to use an integrated elevator car frame and cabin structure that are not manufactured separately, there would be no intermediate locations or vibration isolators between the cabin structure and the frame. If such an alternative elevator car structure were used, a new approach would be required for isolating sheave vibrations of an underslung configuration from the interior of the elevator cab.

SUMMARY

An exemplary elevator system includes an elevator car having an integrated cabin and car frame structure including a platform thickness between a floor surface in the cabin and a lowermost surface on a support beam used for supporting the car beneath the floor surface. A sheave assembly is supported beneath the floor surface. The sheave assembly includes a plurality of sheaves and a plurality of subframe beams. The sheaves and subframe beams fit within the platform thickness such that the subframe beams and the sheaves are no lower than the lowermost surface on the support beam. A plurality of isolation members are between the sheave assembly and the elevator car for isolating an interior of the cabin from vibrations associated with movement of the sheaves.

The various features and advantages of the disclosed examples will become apparent to those skilled in the art from the following detailed description. The drawings that accompany the detailed description can be briefly described as follows.

DETAILED DESCRIPTION

Figure 1:
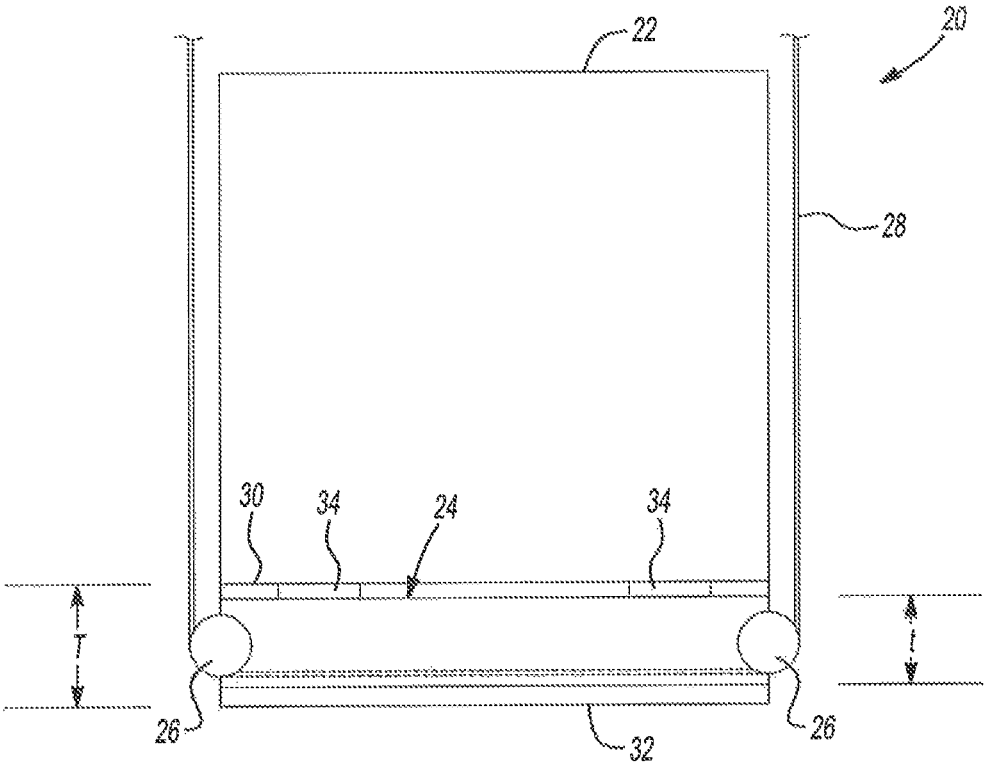
FIG. 1 schematically illustrates selected portions of an example of an elevator system according to an embodiment of this invention.

FIG. 1 schematically shows an elevator system 20 including an elevator car 22. In this example, the elevator car 22 has an integrated cabin and car frame structure. The elevator car 22 does not have a traditional elevator car frame and separately manufactured cabin that is placed onto the frame. Instead, the structural members used for establishing the cabin are also used for establishing the frame of the elevator car 22.

A sheave assembly 24 is supported for movement with the elevator car 22. In this example, a plurality of deflector sheaves 26 direct a roping arrangement 28 to pass beneath the elevator car 22 as the elevator car 22 is suspended and moves within a hoistway, for example.

In the example of FIG. 1, the elevator car 22 has a platform thickness T that corresponds to a dimension between a floor surface 30 inside the elevator car cabin and a lowermost surface 32 on a support beam that is used for support beneath the floor surface 30. The sheave assembly 24 in this example has a thickness t that fits within the platform thickness T of the elevator car 22. In other words, the sheave assembly 24 is nested within the platform thickness T such that the sheaves 26 and subframe beams used for supporting the sheaves 26 do not extend below the lowest surface 32 on the support beam used for support beneath the elevator floor surface 30.

In the example of FIG. 1, the sheave assembly 24 is supported beneath the floor surface 30 of the elevator car 22 with isolation members 34 between the sheave assembly 24 and the elevator car 22. The isolation members 34 comprise resilient pads in some examples. Known materials are used for the isolation members 34 in one example. Example materials include rubber, polyurethane or another elastomer. The isolation members 34 isolate the interior of the cabin portion of the elevator car 22 from vibrations associated with movement of the sheaves 26. This reduces noise and vibration transmissions into the elevator car 22 and provides improved ride quality.

Figure 2:
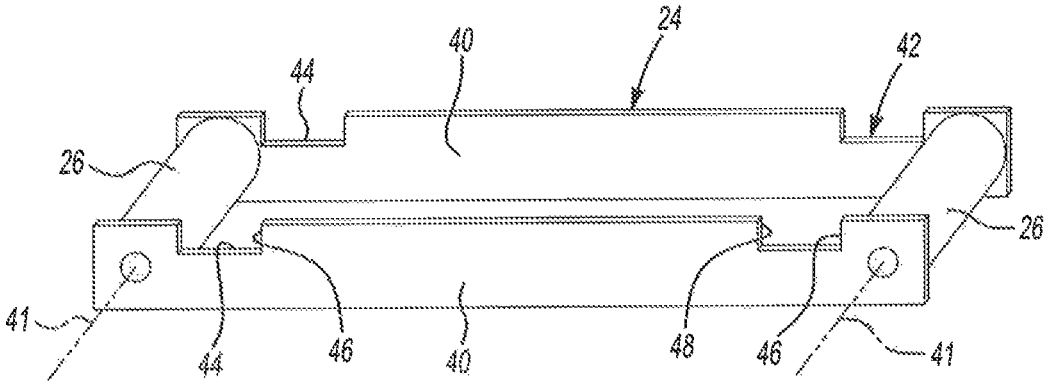
FIG. 2 schematically illustrates an example configuration of a sheave assembly that can be used in the elevator system shown in FIG. 1.

FIG. 2 schematically shows selected portions of one example sheave assembly 24. This example includes a plurality of subframe beams 40 that are arranged parallel to each other. The sheaves 26 are positioned between the subframe beams 40 such that axes 41 about which the sheaves 26 rotate are generally perpendicular to a length of the subframe beams 40.

In this example, each subframe beam 40 includes a plurality of recesses 42. Each recess 42 is configured to at least partially receive an isolation member 34. In this example, the recesses 42 include reaction surfaces 44, 46 and 48. The example isolation members 34 are received against the reaction surfaces 44-48 to prevent relative movement between the sheave assembly 24 and the elevator car 22. The reaction surface 44 limits an amount of upward (according to the drawing) movement and the reaction surfaces 48 and 46 limit movement in a direction parallel to a length of the subframe beams 40 in this example.

Figure 3:
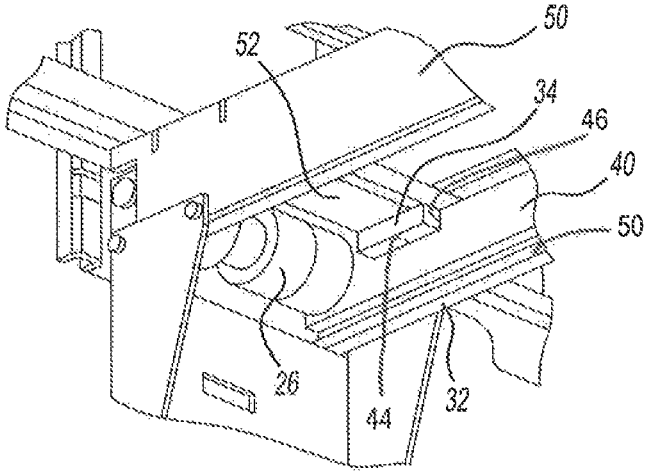
FIG. 3 is a perspective illustration of an example consistent with the embodiment of FIG. 2 shown in relationship to an elevator car structure.
Figure 4:
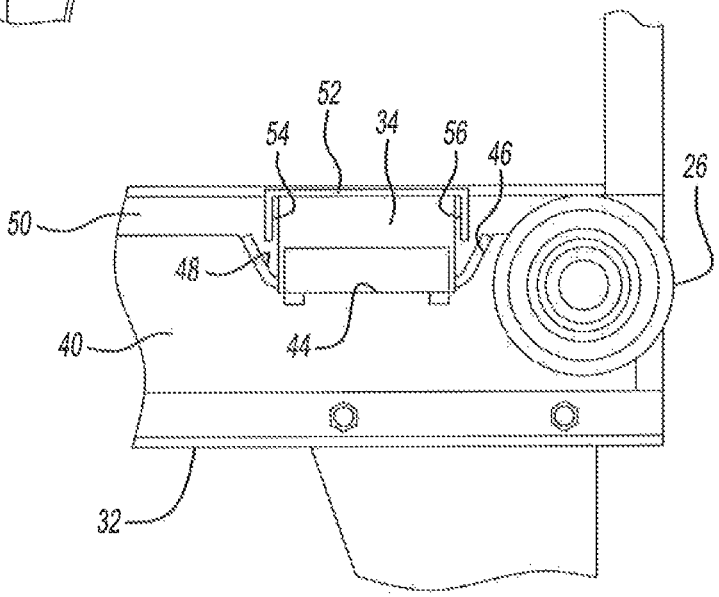
FIG. 4 is a side view of a portion of the example of FIG. 3.
Figure 5:
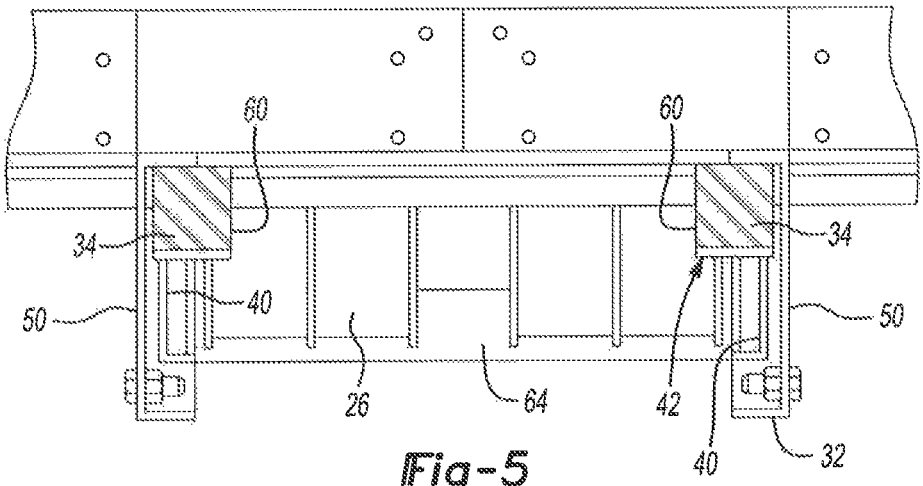
FIG. 5 is another view of the example of FIG. 3.

As can be appreciated from FIGS. 3-5, when the sheave assembly 24 is positioned beneath the elevator car 22, the isolation members 34 are at least partially received within the recesses 42 and against a corresponding structural portion of the elevator car 22. In this example, the subframe beams 40 fit within a space occupied by plank support beams 50 that are used for support beneath the floor surface 30 of the elevator car 22. As can best be appreciated from FIG. 5, the example subframe beams 40 have a generally C-shaped cross-section. The support plank beams 50 have a generally C-shaped cross-section, also. The cross-sectional dimension of the beams 50 is larger than that of the subframe beams 40 such that the subframe beams 40 fit within the cross-section of the support beams 50. Such an arrangement allows for nesting the sheave assembly 24 within the platform thickness T of the elevator car 22. This provides a useful feature in examples where it is desirable to avoid increasing the overall size of the elevator car configuration to maximize space savings.

In the example of FIGS. 3 and 4, a cross-beam 52 provides reaction surfaces on an underside of the elevator car 22. As best appreciated in FIG. 4, reaction surfaces 54 and 56 limit movement of the isolation members 34 and, therefore, the sheave assembly 24 relative to the elevator car 22.

As can be appreciated from FIG. 5, additional reaction surfaces 60 are provided on the example recesses 42 that limit side-to-side movement of the isolation members 34 to further restrict movement of the sheave assembly 24 relative to the elevator car 22.

One feature of the example of FIGS. 2-5 is that the sheave assembly 24 is not fastened to the underside of the elevator car 22 or any of its structural elements. The arrangement of the roping 28 and the weight of the elevator car itself urges the sheave assembly 24 up against the bottom of the isolation members 34, which are urged up into the bottom of the elevator car 22. In other words, the sheave assembly 24 can be considered to be freely suspended beneath the elevator car 22 with the weight of the elevator car cooperating with the roping arrangement 28 to position the sheave assembly 24 beneath the elevator car 22. The reaction surfaces 44-48, 54, 56 and 60, for example, maintain a position of the sheave assembly 24 relative to the elevator car 22.

The example sheave assembly 24 is not completely free of the car 22 because the subframe beams 40 of the sheave assembly 24 are housed within the corresponding C-shaped plank support beams 50 that are, in turn, fastened to the bottom of the car 22. As a result, even if the car 22 is set on its safeties such that the car 22 is immobilized relative to a set of conventional guiding rails (i.e., so that the weight 22 of the car is supported by the rails and not by the roping arrangement 28), the sheave assembly 24 will not separate completely from the car 22, as the subframe beams 40 of the sheave assembly 24 will remain housed within the C-shaped plank support beams 50 fastened to the bottom of the car.

In this example, the isolation members 34 serve to limit movement of the sheave assembly 24 in three directions along three distinct, perpendicular axes (e.g., up and down, side-to-side and front-to-back). The illustrated example provides an efficient way of maintaining a desired position of the sheave assembly 24 relative to the elevator car 22. Additionally, the isolating members 34 minimize any vibrations associated with movement of the sheaves 26 from being transferred to an interior of the cabin of the elevator car 22. The unique mounting arrangement also allows for the sheave assembly 24 to fit within the platform thickness T of the elevator car 22.

Another feature of the illustrated example is that the sheaves 26 are arranged so that they include a spacing 64 between at least two of the sheaves. The spacing 64 accommodates a guide rail 65 along which the elevator car moves. This allows for less space to be occupied compared to other arrangements where there is no overlap in the positioning of the guide rail surfaces and the sheave surfaces.

Figure 6:
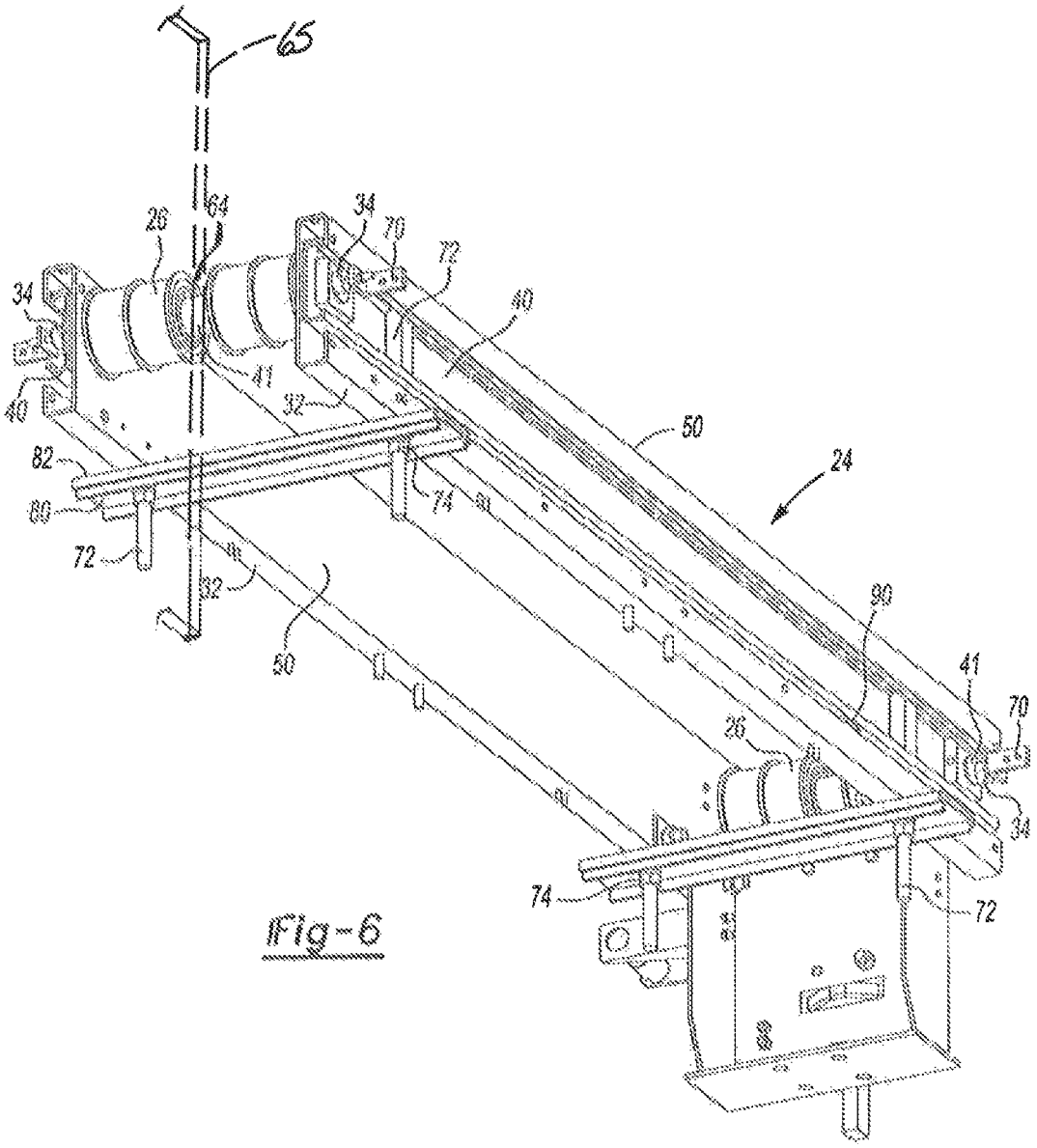
FIG. 6 is a perspective illustration of another example sheave assembly.

FIG. 6 shows another example sheave assembly 24. In this example, the subframe beams 40 are nested within plank support beams 50 such that the subframe beams 40 and the sheaves 26 fit within the platform thickness T of the elevator car 22. In this example, a plurality of bracket members 70 support isolation members 34 that are received near ends of the axes 41 of the sheaves 26. These isolation members 34 limit side-to-side movement of the sheave assembly 24 in a direction parallel to the axes 41 of the sheaves 26.

The example sheave assembly 24 is suspended beneath the elevator car 22 by the weight of the car and the roping arrangement (not specifically illustrated in FIG. 6). In this example, a plurality of rods 72 are connected with the subframe beams 40. Locking members 74 such as nuts secure the rods 72 in a position relative to the support beams 50. The weight of the car will urge the sheave assembly 24 in an upward direction toward the bottom of the elevator car 22. The locking members 74 limit the amount of upward movement of the rods 72 relative to the beams 50. In this manner, the sheave assembly 24 is effectively suspended beneath the elevator car 22 within the platform thickness T such that the sheaves 26 and the subframe beams 40 do not extend below the lowermost surface 32 on the support beams 50. In this example, portions of the rods 72 are positioned below the lowermost surface 32 of the support beams 50.

Figure 7:
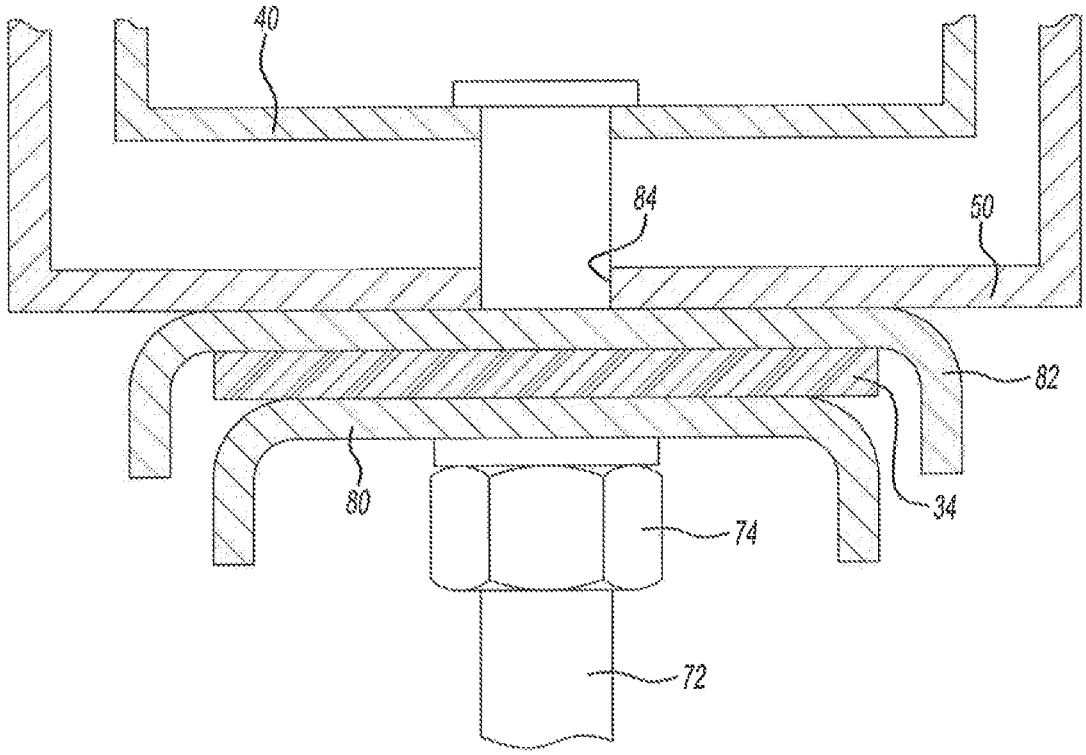
FIG. 7 schematically illustrates selected portions of the example of FIG. 6.

Referring to FIGS. 6 and 7, a first cross-beam 80 is associated with a set of the rods 72 near each end of the subframe beams 40. Isolation members 34 are sandwiched between the first cross-beams 80 and second cross-beams 82. As shown in FIG. 7, each support beam 50 includes an opening 84 through which a portion of each rod 72 is received. The locking members 74 prevent the rods 72 and the associated subframe beams 40 from moving any further upward relative to the support beams 50 from the position shown in the illustration. The weight of the elevator car cooperating with the roping arrangement 28 prevents the sheave assembly 24 from dropping downward relative to the support beams 50. The isolation members 34 minimize any vibration transfer between the sheaves 26 and the structure of the elevator car 22.

Another feature of this example arrangement is that the elongated shape of the rods 72 is different than the generally C-shaped cross-section of the support beams 50 and other structural members of the elevator car 22. The difference in the physical shape of the rods 72 provides a vibration impedance mismatch at the interface between the sheave assembly 24 and the structure of the elevator car 22. This impedance mismatch further limits any noise or vibration transfer into the interior of the cab of the elevator car 22.

Figure 8:
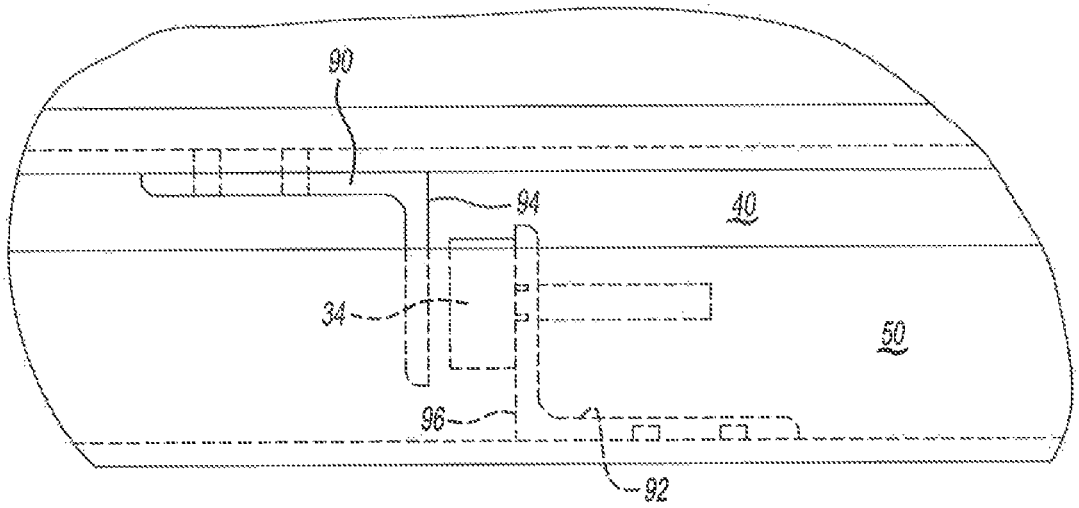
FIG. 8 schematically illustrates another selected portion of the example of FIG. 6.

FIG. 8 schematically shows another isolation member 34 that is configured to limit relative movement between the sheave assembly 24 and the structure of the elevator car 22. In this example, a bracket member 90 is connected to a subframe beam 40 and another bracket member 92 is connected to the support beam 50. The isolation member 34 is positioned between reaction surfaces 94 and 96 on the brackets 90 and 92, respectively. Contact between the isolation member 34 and the reaction surfaces 94 and 96 limits relative movement of the subframe beam 40 relative to the support beam 50 in a direction along the length of the beams. The isolation member 34 associated with the first and second cross-beams 80 and 82 limits relative up or down movement between the sheave assembly 24 and the structure of the elevator car 22. The isolation members 34 supported by the bracket members 70 positioned along the axes 41 of the sheaves 26 limit side-to-side relative movement. The collection of isolation members 34, therefore, limits movement in three directions along three distinct, perpendicular axes.

One feature of the disclosed examples is that the ability to nest the sheave assembly 24 within the car frame structural dimensions allows for realizing an underslung elevator car arrangement that does not increase the platform thickness of the car frame structure. This provides the feature of obtaining space savings and does not require an increase in the size of a pit at a bottom of a hoistway, for example. The illustrated examples also provide an economical arrangement for positioning a sheave assembly beneath an elevator car while isolating an interior of an elevator cabin from vibrations that may be associated with movement of the sheaves of the sheave assembly.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An elevator system, comprising:

an elevator car having an integrated cabin and car frame structure including a platform thickness between a floor surface in the cabin and a lowermost surface on a support beam used for supporting the car beneath the floor surface;

a sheave assembly supported beneath the floor surface, the sheave assembly including a plurality of sheaves and a plurality of subframe beams, the sheaves and subframe beams fitting within the platform thickness such that the subframe beams and the sheaves are no lower than the lowermost surface on the support beam, wherein the subframe beams do not directly contact the elevator car;

a plurality of isolation members between the sheave assembly and the elevator car, the isolation members isolating vibrations associated with movement of the sheaves from an interior of the cabin, wherein the plurality of sheaves rotate about axes and at least one of the isolation members is supported by the elevator car near an end of the axes to prevent relative movement between the sheave assembly and the elevator car in a direction along the axes; and a guide rail along which the elevator car is moveable and wherein the plurality of sheaves include a spacing between at least two of the sheaves along an axis of rotation of the at least two of the sheaves, a portion of the guide rail being received in the spacing between the at least two of the sheaves.

2. An elevator system, comprising:

an elevator car having an integrated cabin and car frame structure including a platform thickness between a floor surface in the cabin and a lowermost surface on a support beam used for supporting the car beneath the floor surface;

a sheave assembly supported beneath the floor surface, the sheave assembly including a plurality of sheaves and a plurality of subframe beams, the sheaves and subframe beams fitting within the platform thickness such that the subframe beams and the sheaves are no lower than the lowermost surface on the support beam; and a plurality of isolation members between the sheave assembly and the elevator car for isolating vibrations associated with movement of the sheaves from an interior of the cabin;

the sheave assembly includes a plurality of rods connected with the subframe beams;

the support beam comprises a corresponding plurality of openings through which at least a portion of the rods are received; and at least some of the isolation members are at an interface between the rods and the support beam.

3. The elevator system of claim 2, wherein the rods extend downward from the subframe beams;

the sheave assembly includes locking members that limit an amount of upward movement between the rods and the support beam; and the at least some of the isolation members are at an interface between the locking members and the support beam.

4. The elevator system of claim 3, comprising at least one cross beam between two of the subframe beams at a location of two of the rods, wherein at least one of the isolation members is located between the cross beam and the support beam.

5. The elevator system of claim 3, wherein a weight of the elevator car urges the subframe beams upward and the locking members are positioned to maintain a vertical position of the sheave assembly relative to the elevator car.

6. The elevator system of claim 4, comprising a second cross beam parallel to and adjacent the at least one cross beam such that the at least one cross beam is at least partially nested within the second cross beam; and wherein the at least one of the isolation members is between the cross beams.

7. The elevator system of claim 6, wherein the subframe beams have a second, generally C-shaped cross-section that is smaller in dimension than the generally C-shaped cross section of the corresponding support beams.

8. The elevator system of claim 6, comprising a first reaction surface connected with one of the support beams;

a second reaction surface connected with one of the subframe beams; and wherein one of the isolation members is positioned to contact each of the first and second reaction surfaces to limit relative movement between the support beam and the subframe beam in a direction parallel to a length of the support beam and the subframe beam.

* * * * *